US008109837B1

(12) United States Patent
Khananayev et al.

(10) Patent No.: US 8,109,837 B1
(45) Date of Patent: Feb. 7, 2012

(54) LASER PUTTING DEVICE

(76) Inventors: Vladimir Khananayev, Wheeleing, IL (US); Marina Borochin, Glenview, IL (US)

( * ) Notice: Subject to any disclaimer, the term of this patent is extended or adjusted under 35 U.S.C. 154(b) by 0 days.

(21) Appl. No.: 12/924,442

(22) Filed: Sep. 27, 2010

(51) Int. Cl.
*A63B 69/36* (2006.01)

(52) U.S. Cl. ..... 473/221; 473/220

(58) Field of Classification Search ..... 473/219–227, 473/257, 266, 267, 268, 278
See application file for complete search history.

(56) References Cited

U.S. PATENT DOCUMENTS 5,388,832 A * 2/1995 Hsu ..... 473/220
5,435,562 A * 7/1995 Stock et al. ..... 473/220
5,465,972 A * 11/1995 Cornett ..... 473/220
5,611,739 A * 3/1997 Carney ..... 473/220
5,725,439 A * 3/1998 Halsey et al. ..... 473/220
6,371,864 B1 * 4/2002 Norwood ..... 473/220
6,796,910 B1 * 9/2004 Foster ..... 473/220
7,118,488 B2 * 10/2006 Chan et al. ..... 473/220
7,153,216 B1 * 12/2006 Pressley ..... 473/220

* cited by examiner

*Primary Examiner* — Nini Legesse
(74) *Attorney, Agent, or Firm* — Michael A. Shariff; Inventa Capital PLC

(57) ABSTRACT

A laser putting device for a golf putter includes a guiding unit for generating a laser beam, a frame for supporting the guiding unit disposed in the frame, an activator connected to the golf putter and communicated with the guiding unit for turning the guiding unit between on and off positions thereby generating the laser beam. A bracket of the laser guiding device is adaptable to receive a tubular member of the guiding unit that has a mirror and a diode emitting the laser beam and guiding the laser beam into the mirror angled in the fashion to form the laser beam having 90 degrees thereby allowing the golfer to point the laser beam at the target point, such as a hole in a golf green. The laser guiding device help the golfer to learn how to improve a strike and place the golf ball into a hole within short period of time and without necessity of using outdoor facility.

19 Claims, 6 Drawing Sheets

LASER PUTTING DEVICE

FIELD OF THE INVENTION

The present invention relates to a laser putting device and more particularly to a golf putter with laser sighting and guiding device.

BACKGROUND OF THE INVENTION

Golf is one of the commonly played games around the world. Lots of people play the golf but only limited number of people really know how to play it right thereby striking the ball correctly in order to place the ball in the hole defined in the golf green. Those who struggle with game know how hard it is to get the ball aimed in the right direction and actually hit the ball in the same direction. Everyone has a unique stroke or technique for lining the ball up with the hole, swinging and actually striking the ball. There is no right way or wrong way to line up and hit a golf ball. There are different ways of training on how to master a perfect swing. There are numerous books and magazines that everyone can afford to either purchase or rent. Most golf courses worldwide offer lessons on golf, from the basics to more advanced techniques. Numerous other types of training and teaching devices have been developed in an attempt to improve a golfer's putting stroke and alignment.

There are several phases of a putting stroke. Typically, the putting stroke includes the address or set-up phase which the golfer initially assumes in relation to the ball with the club head located behind the ball before hitting a shot; the backswing phase in which the club is drawn back into a cocked position; the striking phase in which the putter is moved to and through the ball; and the follow-through phase of the stroke in which the putter is moved past and beyond the hitting zone to finish the stroke. There is a longstanding need for a device to enable the golfer to be confident of their initial aim at the target and their execution during play. Enhanced practice can achieve that goal. Moreover, there is a need for a device that allows an accurate check of putter aim and which allows the golfer to actually visualize correct putter direction, thus making it possible to repeat on the golf course. Also, there is a need for a device that allows a check on the quality of the putting motion itself.

The prior art is replete with various suspension systems having aimed to improve putting stroke. These systems are taught by the U.S. Pat. Nos. 5,213,331 to Avanzini; 6,227,983 to Yang; 6,605,005 to Lin; and 7,318,778 to Owens.

U.S. Pat. No. 5,213,331 to Avanzini, for example, teaches a putter with laser sighting including a laser unit formed with or permanently mounted onto the putter head. The laser unit is adjustably mounted on the putter head for adjustment of the laser beam in a vertical plane perpendicular to the putter's ball striking surface so that the laser beam may be projected over the top of a golf ball onto a putting surface at select distances forwardly of the golf ball. The laser unit preferably includes a button mounted on the handle of the putter. The laser unit is mounted in such a fashion wherein it circumscribes the neck of the putter head thereby sliding along the same as the golfer swings the putter thereby preventing golfer from concentrating on strike of the ball.

U.S. Pat. No. 6,605,005 to Lin teaches a detachable laser pointer is constructed to include a mounting base, the mounting base having a smoothly arched rear coupling groove for coupling to the shaft of a golf putter and a locating plate of C-shaped cross section upwardly extended from the smoothly arched coupling groove for plugging in between the shaft and grip of the golf putter and a front receiving groove, a joint rotatably coupled to the receiving groove, a laser module pivoted to the joint and adapted for emitting a laser beam to aim the putter head of the golf putter to the hole. Similarly to the U.S. Pat. No. 5,213,331 to Avanzini, the laser pointer is mounted in such a fashion wherein it circumscribes the handle of the putter head thereby sliding along the same as the golfer swings the putter thereby preventing golfer from concentrating on strike of the ball.

To eliminate drawbacks of the aforementioned prior art references, another prior art reference, namely U.S. Pat. No. 6,227,983 to Yang taught a laser pointer is directly installed in the putter head, and controlled to emit a laser beam (or two laser beams) perpendicular to the striking face of the putter head. Because the laser pointer is directly installed in the putter head, it is not detachable for use with a regular golf putter without laser pointer means. Another drawback of these designs is that the user may not be able to see the laser beam clearly when looked at the ground because the laser beam extends from the front side of the striking face of the putter head. Furthermore, because the switch of the laser pointer is provided at the putter head, the user must stop the action of aiming the putter head at the hole when switching the switch.

Therefore, an opportunity exists for an improved system and method of golf training device and more particularly to a golf putter with laser sighting and guiding device.

SUMMARY OF THE INVENTION

A laser putting device (the device) of the present invention is used to assist golfers or those who begin training of in golf. The device is intended for training a putting, and more particularly to improving aiming, swing, and impacting on a golf ball thereby landing the golf ball in a hole defined in golf green. The device is connected to a putter that includes an electrically conductive shaft, and a neck as rectangle bar. The device includes a laser index unit, a frame connected to the bracket for supporting the laser index unit, and a plate contact element electrically communicated with the laser index unit by a wire and electrically conductive shaft.

The laser index unit presents a housing tubular configuration of a circular cross section. A front portion or nose element is connected to the housing. A mirror is located in the nose element. A switch is disposed in the housing to connect batteries with a laser diode located in the housing. The mirror receives a red laser beam from a laser diode and extending generally perpendicular to the axis of the housing. The wire interconnects the laser index unit with the plate contact element. The plate contact element is attached to the handle by an elastic strip. The golfer activates the laser diode by pressing the plate contact element and connecting a shaft.

The frame includes a plate presenting a cover extending to a first end or flange and a second end or flange extending generally perpendicular to the cover. The first and second ends define opening to receive the laser index unit extending therethrough. The cover presents spaced edges defining a wave-like or non-planar contour to provide clear distinction between the cover and the head portion of the putter thereby not confusing and distracting the golfer as the golfer is preparing to make a strike. The bracket includes a shoe or a lower bracket presenting a first wall extending to a support lip presenting a pair of female connectors aligned with a pair of female connectors defined in the cover for supporting the cover and connected to the cover by a pair of male connectors.

A middle portion integrally extends from the first wall in a substantially perpendicular fashion. A front portion extends from the middle portion and is spaced from the first wall. The first wall and the front portion extend substantially parallel to one another. A leg member extends from the front portion thereby defining L-shaped configuration of the front portion. A pushing element or stopper extends from a top of the front porting and is intended to push the neck portion of the head portion of the putter. The device, when installed on the putter, has the bracket and the lower part of the bracket extending on a striking surface of the putter and a stopper of the front portion pushes the neck. The middle wall pushes the neck side and extends on the upper part of the putter.

A fastener extending through the first wall tights the lower bracket about the head and the neck portion of the head thereby rigidly connecting the laser index unit to the putter and preventing relative movement of the laser index unit with respect to the putter. Such attachment secures a stable location of the laser index unit and a laser beam relatively to the striking surface of the putter. The fastener is located behind the neck and in center of virtual triangle, where a lower edge of the front wall of the bracket is a base of triangle and the stopper is its apex. Training appliances can be used with the device for training a putting as separate elements such swing, aiming, and impacting the ball. The training appliances include a control strip with a bright center line, a target simulating a hole in the golf green.

A system of the present invention provides numerous advantages over prior art designs.

An advantage of the present invention is to provide the device which is sturdy, monolithic, and stable in keeping a factory calibrated device generating a laser beam, easily installed on the putter, using hard rests without the use of any tools, and does not need in a further adjustment of the laser beam direction.

Another advantage of the present invention is to provide the device is turning on by golfer's decision, being in a playing posture with unlimited place of a gripping a handle of the putter for checking only of a quality of aiming by the putter.

Still another advantage of the present invention is to provide the improved link for the suspension system that is stamped from a light weight sheet metal.

Still another advantage of the present invention is to provide a system designed to help the golfer to learn how to improve a strike and place the golf ball into a hole within short period of time and without necessity of using outdoor facility.

Still another advantage of the present invention is to provide the system that will allow the golfer to use the same independently without anyone's help wherein the golfer creates a visual memory of an aiming and muscular memory of a swing at a reflex level for just several hours of training.

Still another advantage of the present invention is to provide a putter wherein the location of the laser index unit relative the head portion is fixed and direction of the laser beam relative the striking surface is controlled.

Still another advantage of the present invention is to provide a putter wherein the location of the laser index unit relative the head portion does not block a view of the striking surface of the head portion as view from the top by the golfer and does not prevent to strike the ball.

Still another advantage of the present invention is to provide the system having bright flashes of a laser spot on the objective thereby giving an impulse aggravating memory created in the golfer's mind. After exercises with a strip type of a bright line for a long time remains in memory of the golfer, thereby helping the golfer in aiming during the game of golf.

Still another advantage of the present invention is to provide the method whereby reiteration of the elementary movements allows the golfer to learn on how to do improve a pendular swing with both hands holding the putter.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
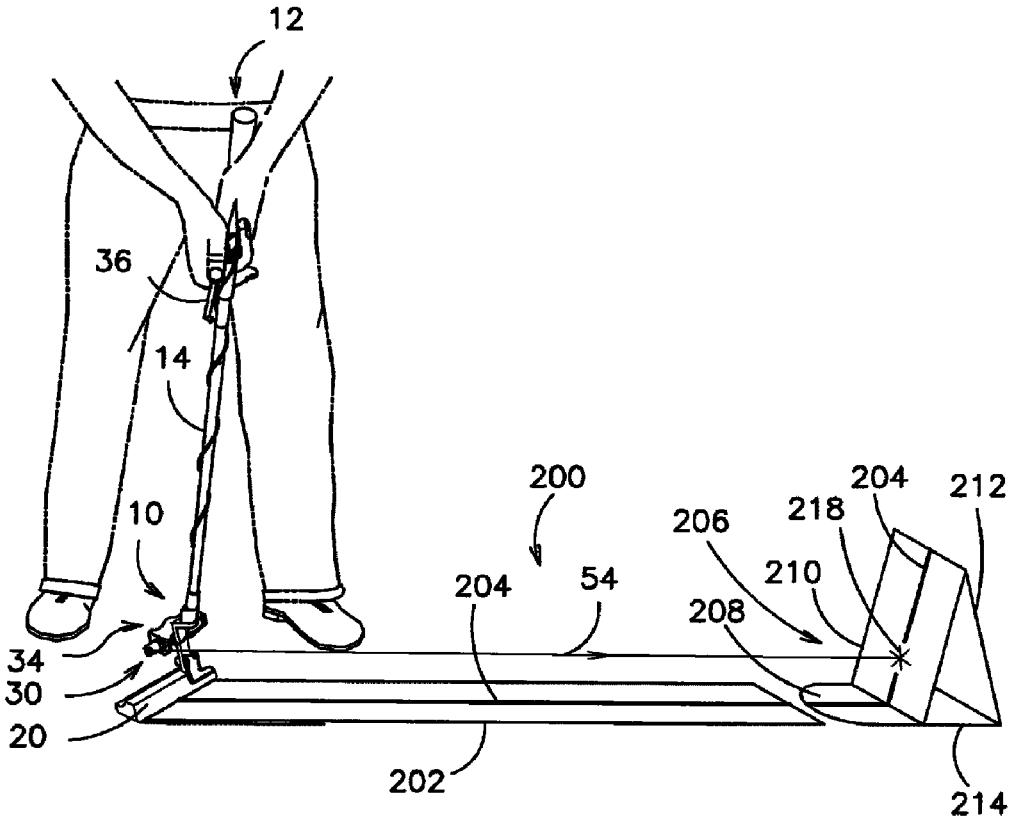
FIG. 1 illustrates a perspective view of a laser putting device of the present invention installed on the putter and a checking a laser beam direction by a training appliances.

Referring to the Figures, wherein like numerals indicate like or corresponding parts, a laser putting device, generally shown at 10, (the device) of the present invention is used to assist a golfer (shown in phantom in FIG. 1) or those who begin training of in a golf. The device 10 is intended for training, and more particularly to improve aiming, swing, and impacts on a golf ball thereby landing the golf ball in a hole defined in golf green from any distances. The device 10 is connected to a standard putter, generally shown at 12 in FIGS. 1 and 2. The putter 12 includes a handle 16, an electrically conductive shaft 14, and a head portion 18 with a striking surface 20.

A neck 22 extends from the head portion 18 to interconnect the head portion 18 with the shaft 14. The neck 22 presents a rectangular configuration. A collar 24 is connected to the neck 22 to receive the shaft 14. The device 10 includes several parts connected to one another. These four main components of the device 10 are a laser index unit 30, a bracket 32, a frame 34 connected to the bracket 32 for supporting the laser index unit 30, and a plate contact element 36 electrically communicated with the laser index unit 30 by a wire 38 and the shaft 14. Those skilled in the art will appreciate that other operable communication methods maybe used to connect the laser index unit 30 with the plate contact element 36.

The laser index unit 30 is an optical-emitting device selected from the group of consisting visible lasers and modified to match the laser putting device. The modification includes a changing of direction of the laser beam 54 and changing a connection of the batteries 52 with a housing 42 to a connection with a wire 38 and plate contact element 36 controlled by the golfer. The laser index unit 30 presents a housing 42 of a tubular configuration with a circular cross section. Alternatively, the tubular housing 42 may present a non-circular cross section without limiting the scope of the present invention.

Alluding to the above, a front portion of laser index unit 30 or nose element 44 is connected to the housing 42. A mirror 46 is located in the nose element 44. A switch 48 is disposed in the housing 42 to connect the batteries 52 to the laser diode 58. A power source, i.e. several batteries 52 are disposed in the housing 42 to provide power to the device 10. Those skilled in the art will appreciate that the batteries 52 may be lithium ion batteries or any other electro chemical devices without limiting the scope of the present invention.

Figure 7:
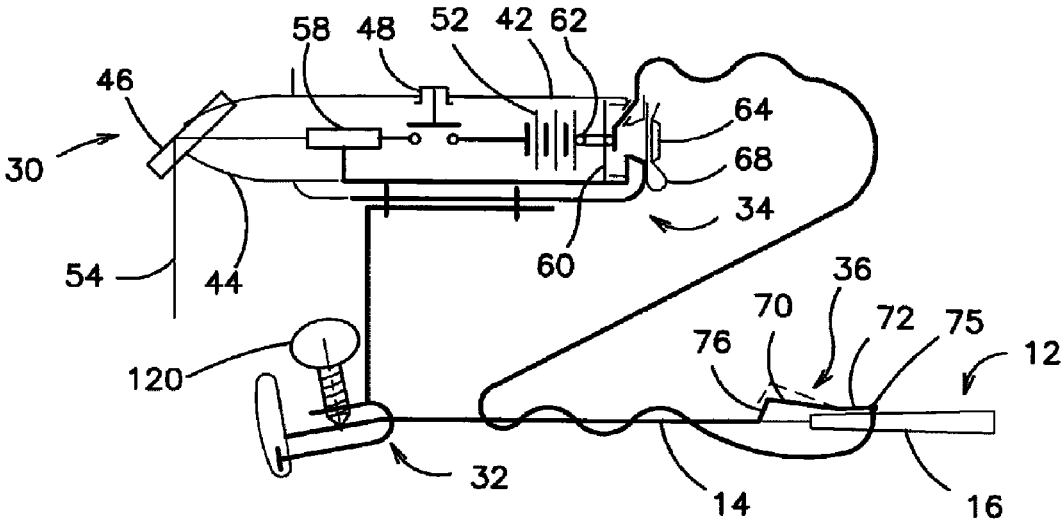
FIG. 7 illustrates a schematic view of the laser putting device.
Figure 8:
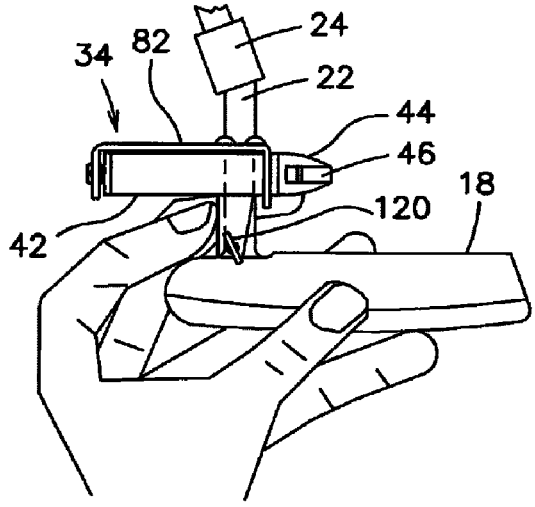
FIG. 8 illustrates a fragmental and back view of the laser putting device connected to the head portion of the putter.

As best shown in FIG. 7, the mirror 46 receives a red laser beam 54 from a laser diode 58 located inside the housing 42 and extending perpendicular to the axis of the housing 42. The diode 58 is powered by the batteries 52 and is activated by the switch 48 and the plate contact element 36 as desired by the golfer.

As best shown in FIG. 7, the laser diode 58 radiates the red laser beam 54 which later is directed perpendicularly of the axis of the housing 42 as it reflects from and by the mirror 46 oriented at the angle of 45 degrees defined between the axis of the housing 42 and the mirror 46 thereby creating the angle of 90 degrees between the segment of the red laser beam 54 as it extends along the axis of the housing 42 and then reflects from the mirror 46 and away from the laser index unit 30. A disc or plate 60 formed from a non-conductive material closes the housing 42 from a rear end thereby keeping the batteries 52 and the diode 58 inside the housing 42 thereby preventing relative motion of the same inside the housing 42.

Figure 6:
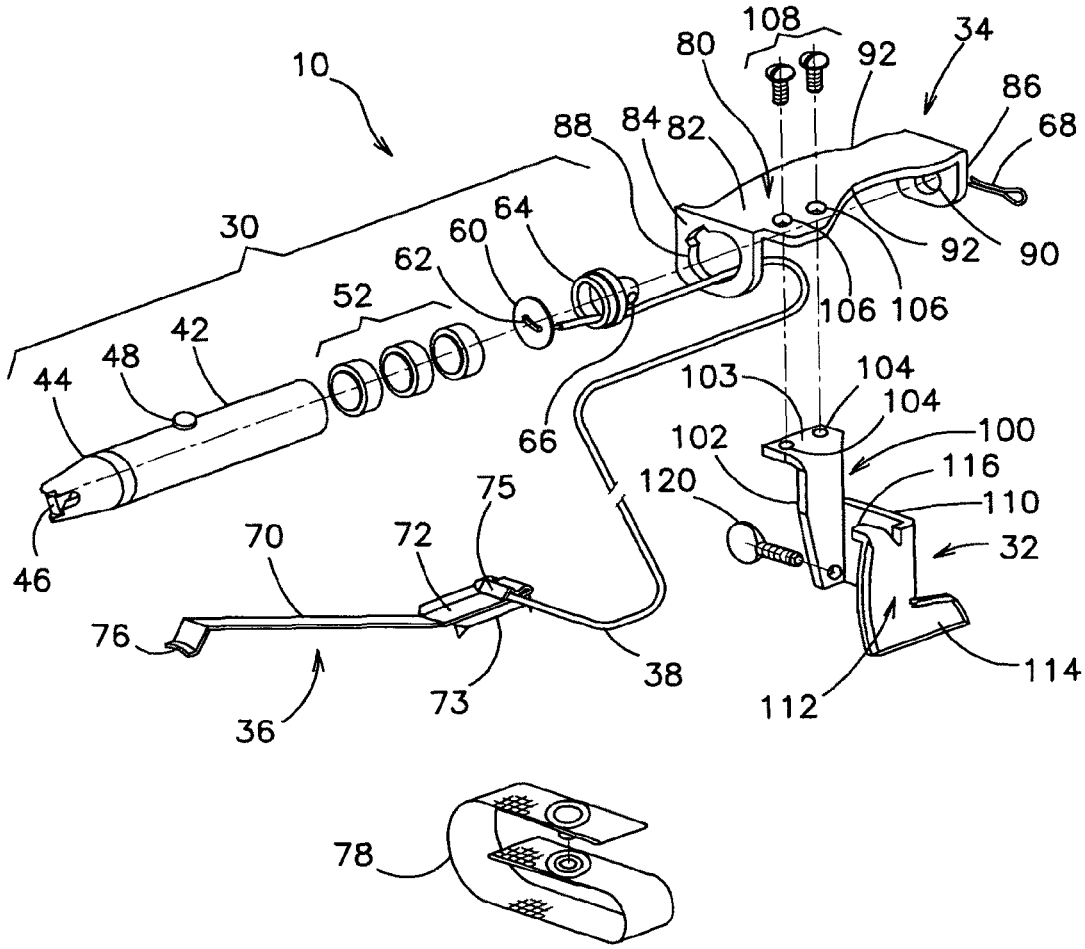
FIG. 6 illustrates an exploded view of the laser putting device having a bracket for connecting the laser device to the head portion of the putter.

As best shown in FIGS. 6 and 7, a contact 62 extends from the disc 60 for receiving the wire 38 thereby electrically connecting the wire 38 with the batteries 52. A cap 64 having a female connector 66 is designed to receive a pin or male connector 68 thereby securing the housing 42 within the frame 34. The wire 38 interconnects the laser index unit 30 with the plate contact element 36 that is further defined by a spring contact 70 having a lower bend portion 76 and an upper bend portion 72 and an end portion 75 connecting to the upper bend portion 72 with a guide 73. A bare end of the wire 38 squeezed into the end portion 75 of the plate contact element 36. The guide 73 having four sharp lids corners connects to the soft handle of the putter. The plate contact element 36 is attached to the handle 16 by an elastic strip 78. Those skilled in the art will appreciate that other connection elements may be used instead of the elastic strip 78 without limiting the scope of the present invention.

FIGS. 3 through 7 illustrate all elements of the device 10 that present the device 10 in both schematic view, as shown in FIG. 7, and exploded view, as shown in FIG. 6. The laser index unit 30 will radiate a laser beam 54, when a switch 48 was preliminary turned on, and a golfer connects by pushing spring contact 70 with the electrically conductive shaft 14.

As best shown in FIG. 6, the frame 34 for supporting the laser index unit 30 is illustrated. The frame 34 includes a cover, generally indicated at 80 presenting a flat portion or cover 82 extending to a first end or flange 84 and a second end or flange 86 extending generally perpendicular to the flat portion 82. The first and second ends 84 and 86 define openings 88 and 90, respectively, to receive the laser index unit 30 extending therethrough. The cover 82 presents spaced edges 92 defining a wave-like or non-planar contour to provide clear distinction between the cover 82 and the head portion 18 of the putter 12 thereby not confusing and distracting the golfer as the golfer is preparing to make a strike. Many other contours may be used on the cover without limiting the scope of the present invention.

The frame 34 is connected to the bracket 32 that further includes a shoe or a lower bracket, generally indicated at 100, presenting a first wall 102 extending to a support lip 103 presenting a pair of female connectors 104 aligned with a pair of female connectors 106 defined in the cover 82 for supporting the cover 82 and connected to the cover 82 by a pair of male connectors 108. A middle portion 110 integrally extends from the first wall 102 in a substantially perpendicular fashion. Alluding to the above, a front portion 112 extends from the middle portion 110 and is spaced from the first wall 102. The first wall 102 and the front portion 112 extend substantially parallel to one another.

A leg member 114 extends from the front portion 112 thereby defining L-shaped configuration of the front portion 112. A pushing element or stopper 116 extends from the front portion 112 and is intended to push the neck portion 22 of the head portion 18 of the putter 12. A fastener 120 extending through the first wall 102 tights the leg member 114 and the middle portion 110 about the head 18 and the neck portion 22 of the head 18 thereby rigidly connecting the laser index unit 30 to the putter 12 and preventing relative movement of the laser index unit 30 with respect to the putter 12. The leg member 114 rigidly connects to and extends over the striking surface 20 of the putter 12 to ensure stable direction of the laser beam 54. The bracket 32 is formed from metal or polymeric materials without limiting the scope of the present invention. The bracket 32 may be injection molded or stamped without limiting the scope of the present invention. The device 10 is sturdy construction, using hard rests for installation on the putter, stable keeping a direction of the laser beam 54, and does not keep a the golfer's attention to itself as the golfer is preparing to make a strike.

Figure 2:
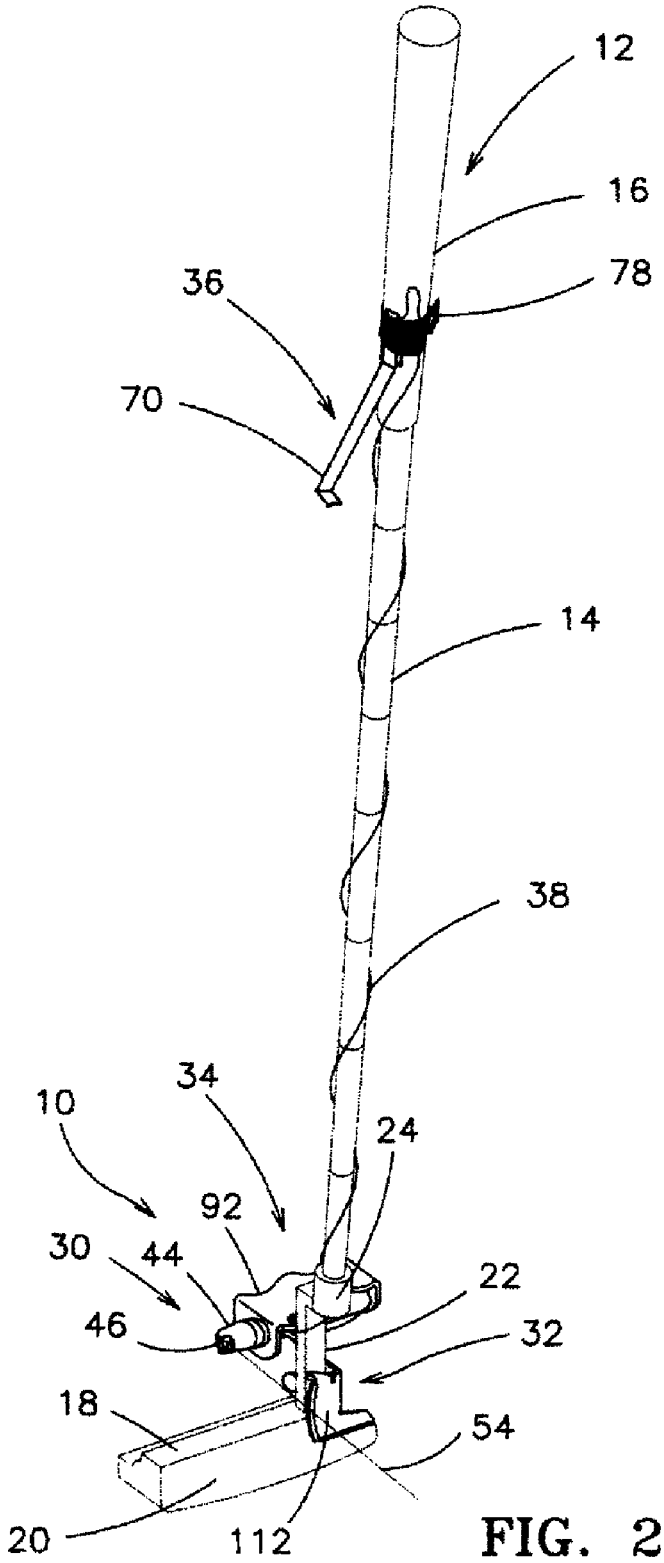
FIG. 2 illustrates a perspective view of a putter with a laser putting device of the present invention.
Figure 3:
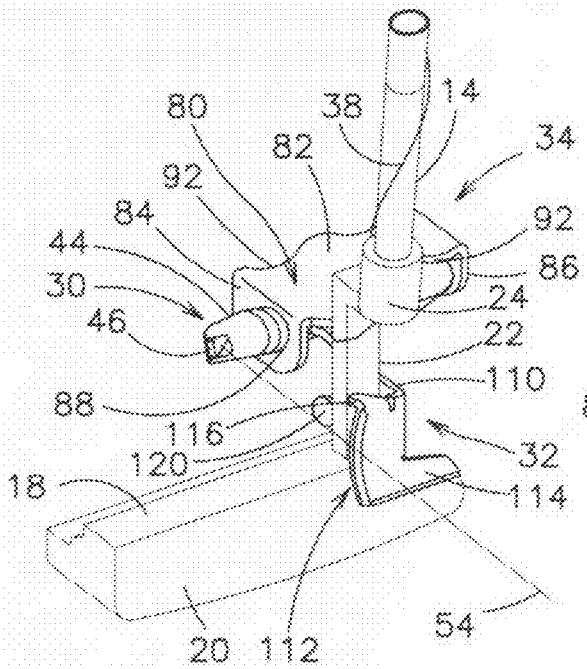
FIG. 3 illustrates a fragmental view of the laser putting device connected to a head portion of the putter.
Figure 4:
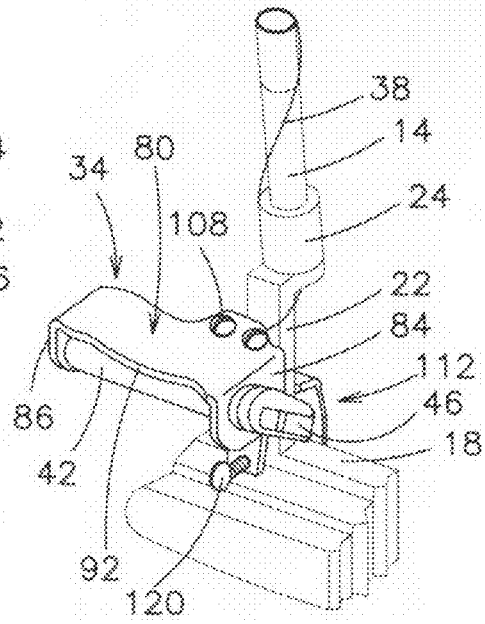
FIG. 4 illustrates another fragmental view of the laser putting device connected to the head portion as viewed from a different angle as compared to FIG. 3.
Figure 5:
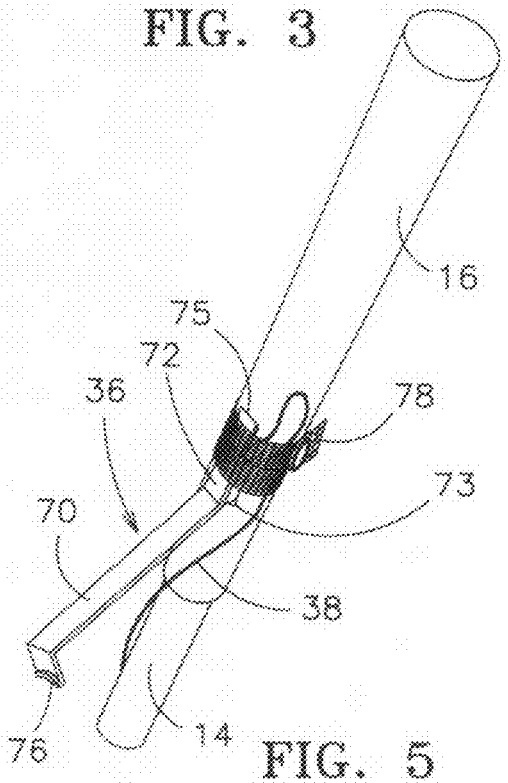
FIG. 5 illustrates a fragmental view of a plate contact element attached on a handle of the putter.

Referring to FIG. 1, the device 10 further can use training appliances for exercise, generally shown at 200. The appliances 200 include a strip 202 having a central line 204. The strip 202 is fabricated from any flexible material such as polymer without limiting the scope of the present invention thereby allowing the golfer to fold the strip 202 and store the same after the strip 202 is not used. Alternatively, the strip 202 may be formed from several parts foldable to form a unitary part also adaptable for easy storage. The central line 204 may be presented in a bright color to be visible and distinctive when in use. Alternatively, the central line 204 is a separate element easily removable from the strip 202 when not in use. Other forms and shapes of the central line 204 may be used in connection with the invention without limiting the scope of the present invention.

A target section is generally indicated at 206. The target section 206 includes at least four sections such as a front section 208 as imitation of a hole extended further to a front wall 210 then to a rear wall 212 and then to a base wall 214. The target section 206 is foldable to allow easy storage and transportation when not in use. The bright and visibly distinct laser spot 218 shows direction of the laser beam 54 on the front wall 210 to make sure the direction of the laser beam 54 is perpendicular to the striking surface 20 of the putter 12. Similarly to the strip 202, the target section 206 is fabricated from any flexible material such polymer without limiting the scope of the present invention thereby allowing the golfer to fold the section 206 and store the same after the target section 206 is not used. The target section 206 also includes the central line 204 extending through the front section 208 and the front wall 210. The central line 204 may be presented in a bright color to be visible and distinctive when in use.

Figure 9:
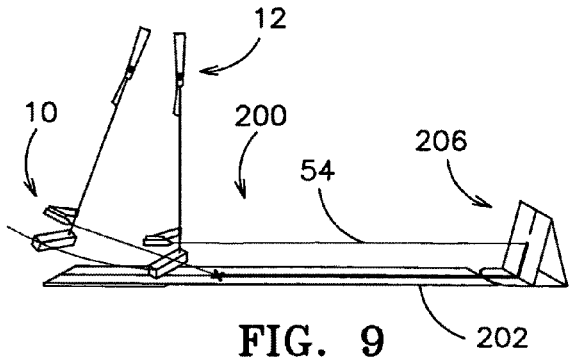
FIGS. 9 through 12 illustrate steps of improving skills of swing, aiming, and impact while training.

As the exercise begins, the laser beam 54 is activated temporarily by the golfer, shows a direction to objective and orientation of a strike surface 20 of head putter 18, as shown in FIG. 1. The trajectory of movement of the striking surface 20 during swing conforms to a trajectory of movement of the laser spots on the strip 202, as shown in FIG. 9. Reiteration of the elementary movements will form a reflex in the golfer's memory to correctly perform pendular swing by correctly holding the putter 12 with both hands.

Figure 10:
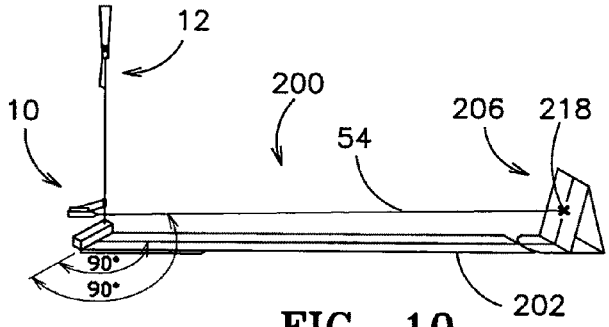
Figure 11:
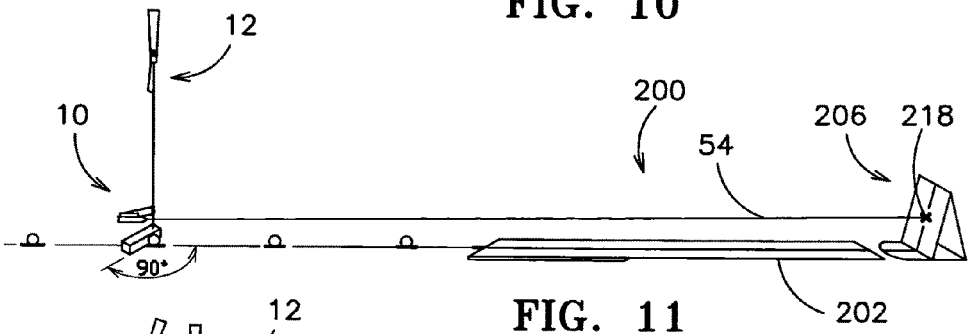
Figure 12:
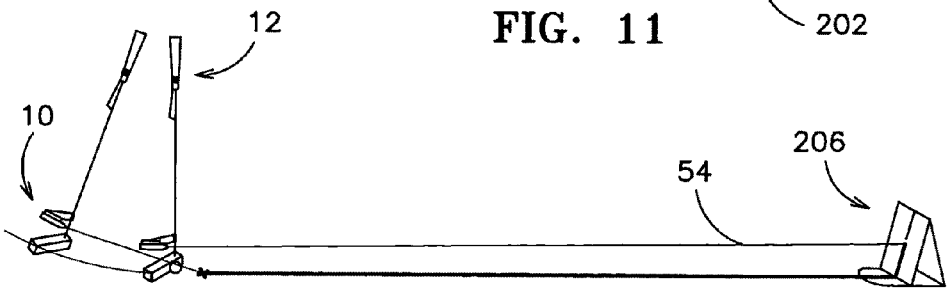

During the exercise, as best shown in FIGS. 10 and 11, the golfer aims the putter 12 and then supervises an aiming of the device 10 by the laser and gradually increases distances. In final exercise that is shown in FIG. 12, the golfer can check a quality of an aiming, swing, and location of the putter at impact, watching of a motion of a laser spot on a floor and the target.

As best shown in FIGS. 9 through 12, the device 10 used during the exercises with allows the golfer to create a visual memory of an aiming and muscular memory of pendular swing, wherein it turns to a reflex every time the golfer is ready to swing the putter to strike the ball. The present invention provides numerous advantages over prior art designs and methods and is designed to help the golfer to learn how to improve a strike and place the golf ball into a hole within short period of time and without necessity of using outdoor facility. The golfer can use the system independently without anyone's help, and is capable to create a visual memory of an aiming and muscular memory of a swing at a reflex level for just several hours of training. Bright flashes of a laser spot on objective give an impulse aggravating memory created in the golfer's mind. After exercises with the strip type of a bright line for a long time remains in memory of the golfer, thereby helping the golfer in aiming during the game of golf. Reiteration of the elementary movements allows the golfer to learn on how to do improve a pendular swing with both hands holding the putter.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A guiding device for a putter having a shaft, a handle, and a head portion with a neck portion and a striking surface with said device adaptable for guiding a direction of a strike, said guiding device comprising:

a guiding unit for generating a light beam;

a frame for supporting said guiding unit disposed in said frame, an activator connected to the shaft and communicated with said guiding unit for turning said guiding unit between on and off positions thereby generating the light beam; and a bracket connected to said frame for rigidly joining said guiding unit to the neck portion of the putter with said bracket presenting a tubular configuration thereby covering the neck portion of the shaft and at least the striking surface of the head portion by placing said guiding unit opposite from the striking surface of the head portion and a pushing element extending from said bracket for applying pressure to the neck portion of the head portion of the putter thereby rigidly connecting said guiding unit to the head portion to prevent relative movement of said guiding unit as the putter is moved between various directions.

2. A guiding device as set forth in claim 1 wherein said frame includes a first plate presenting a flat portion extending to a first flange and a second flange extending generally perpendicular to said flat portion, said first and second flanges defining openings to receive said guiding unit extending therethrough.

3. A guiding device as set forth in claim 2 wherein said flat portion presents spaced edges defining a non-planar contour.

4. A guiding device as set forth in claim 2 wherein said bracket further includes a lower bracket portion presenting a first wall extending to a support lip connected to said flat portion.

5. A guiding device as set forth in claim 4 wherein said bracket further includes a middle portion integrally extends from a first wall in a substantially perpendicular fashion.

6. A guiding device as set forth in claim 5 including a front portion extending from said middle portion and is spaced from said first wall.

7. A guiding device as set forth in claim 6 including a leg member extending from said front portion thereby defining L-shaped configuration of said front portion.

8. A guiding device as set forth in claim 7 including a fastener extending through said first wall thereby rigidly tightening said bracket about the head portion and the neck portion of the putter thereby preventing relative movement of said guiding unit with respect to the putter.

9. A guiding device as set forth in claim 8 wherein said bracket is formed from at least one of metal and polymeric materials.

10. A guiding device as set forth in claim 9 wherein said guiding unit presents a housing having a tubular configuration of a circular cross section, a nose portion and a rear portion.

11. A guiding device as set forth in claim 10 including a mirror located in said nose portion.

12. A guiding device as set forth in claim 11 including a power source and a laser diode disposed in said housing to provide power to said device wherein said mirror receives a red laser beam from said laser diode extending along an axis of said housing and directing said red laser beam perpendicularly of said axis as said red laser beam reflects from and by said mirror oriented at the angle of 45 degrees defined between said axis of said housing and said mirror thereby creating an angle of 90 degrees.

13. A guiding device as set forth in claim 12 including a wire interconnecting said power source with a spring contact having a lower bend portion and an upper bend portion and an end portion connecting to said upper bend portion with a guide element.

14. A guiding device as set forth in claim 1 including a plate contact element connected to the handle of the putter.

15. A guiding device as set forth in claim 1 wherein said bracket presents a monolithic construction.

16. A guiding device for a putter having a shaft and a head portion with a neck portion and a striking surface with said device adaptable for guiding a direction of a strike, said guiding device comprising:

a guiding unit for generating a light beam;

a frame for supporting said guiding unit disposed in said frame, a bracket connected to said frame and presenting a tubular configuration thereby covering the neck portion of the shaft and at least the striking surface of the head portion by placing said guiding unit opposite from the striking surface of the head portion and a fastener extending through said bracket thereby rigidly tightening said bracket about the head portion and the neck portion of the putter and a pushing element extending from said bracket for applying pressure to the neck portion of the head portion of the putter to prevent relative movement of said guiding unit with respect to the putter and to prevent relative movement of said guiding unit as the putter is moved between various directions.

17. A guiding device as set forth in claim 16 wherein said frame includes a first plate presenting a flat portion extending to a first flange and a second flange extending generally perpendicular to said flat portion, said first and second flanges defining openings to receive said guiding unit extending therethrough.

18. A guiding device as set forth in claim 17 wherein said bracket further includes a lower bracket portion presenting a first wall extending to a support lip connected to said flat portion for supporting said flat portion and a middle portion integrally extends from said first wall in a substantially perpendicular fashion.

19. A guiding device as set forth in claim 18 including a front portion extending from said middle portion and is spaced from said first wall.

* * * * *